US007410229B2

(12) United States Patent
Pohl et al.

(10) Patent No.: US 7,410,229 B2
(45) Date of Patent: Aug. 12, 2008

(54) REFRIGERATOR WITH BOWED MULLION

(75) Inventors: Douglas A. Pohl, Benttendorf, IA (US); Eugene H. Schuchert, Iowa City, IA (US)

(73) Assignee: Whirlpool Corporation, Benton Harbor, MI (US)

( * ) Notice: Subject to any disclaimer, the term of this patent is extended or adjusted under 35 U.S.C. 154(b) by 474 days.

(21) Appl. No.: 11/033,549

(22) Filed: Jan. 12, 2005

(65) Prior Publication Data

US 2006/0152124 A1 Jul. 13, 2006

(51) Int. Cl.
*A47B 96/04* (2006.01)

(52) U.S. Cl. ..... 312/407; 312/401; 312/406

(58) Field of Classification Search ..... 312/401, 312/402, 405, 406, 406.1, 406.2, 407, 407.1; 62/441, 447, 440; 49/501; 220/592.02, 592.03, 220/592.04, 592.2, 826
See application file for complete search history.

(56) References Cited

U.S. PATENT DOCUMENTS

| | | | | | |
|---|---|---|---|---|---|
| 2,078,552 | A | * | 4/1937 | Young | 312/405 |
| 2,347,985 | A | * | 5/1944 | Beersman | 312/405 |
| 2,486,507 | A | * | 11/1949 | Szymczyk | 312/405 |
| 2,522,465 | A | * | 9/1950 | Romito | 312/405 |
| 2,767,040 | A | * | 10/1956 | Kesling | 312/296 |
| 3,221,085 | A | * | 11/1965 | Rill, Jr. et al. | 312/406.2 |
| 3,726,578 | A | | 4/1973 | Armstrong | |
| 4,714,304 | A | * | 12/1987 | Sisk et al. | 312/406.2 |
| 4,884,415 | A | * | 12/1989 | Mandel et al. | 62/441 |
| 5,033,182 | A | | 7/1991 | Winterheimer et al. | |
| 5,271,671 | A | * | 12/1993 | Mandel | 312/405 |
| 5,306,082 | A | | 4/1994 | Karlin et al. | |
| 5,704,107 | A | | 1/1998 | Schmidt et al. | |
| 5,992,960 | A | | 11/1999 | Wolanin | |
| D418,845 | S | | 1/2000 | Jackovin | |
| 6,019,447 | A | | 2/2000 | Jackovin | |
| 6,036,292 | A | | 3/2000 | Mandel et al. | |
| D431,577 | S | | 10/2000 | Jackovin | |
| 6,266,970 | B1 | * | 7/2001 | Nam et al. | 312/406 |
| 2002/0020184 | A1 | | 2/2002 | Playford | |
| 2002/0117949 | A1 | | 8/2002 | Banicevic et al. | |
| 2003/0141793 | A1 | | 7/2003 | Lee | |

FOREIGN PATENT DOCUMENTS

| | | | | |
|---|---|---|---|---|
| JP | 53067158 | * | 6/1978 | 312/406 |

* cited by examiner

*Primary Examiner*—Lanna Mai
*Assistant Examiner*—Hanh V Tran
(74) *Attorney, Agent, or Firm*—Kirk Goodwin; Michael D. Lafrenz

(57) ABSTRACT

A side-by-side refrigerator includes a cabinet defining fresh food and freezer compartments, with each compartment having upper and lower sections which vary in width and volume and corresponding fresh food and freezer doors that vary in width. The fresh food and freezer compartments are spaced by a mullion against which the doors seal. The mullion is bowed such that the longitudinal curvature of the mullion compensates for thermal bowing of the fresh food and freezer doors, thereby assuring a proper seal between the mullion and the fresh food and freezer doors.

3 Claims, 3 Drawing Sheets

REFRIGERATOR WITH BOWED MULLION

BACKGROUND OF THE INVENTION

1. Field of the Invention

The present invention pertains to the art of refrigerators and, more particularly, a side-by-side refrigerator including laterally spaced compartment doors which seal against a bowed mullion.

2. Discussion of the Prior Art

In a conventional side-by-side refrigerator, freezer and fresh food compartment doors align along a vertically extending divider wall or mullion, with the mullion extending in a single plane essentially from the top to the bottom of the refrigerator. Although this style of refrigerator has certain advantages over either a top-mount or a bottom-mount refrigerator wherein the freezer compartment is arranged vertically above or below the fresh food compartment respectively, certain disadvantages are also presented. For instance, since the opening provided in a household kitchen for side-by-side, top-mount and bottom-mount style refrigerators is essentially standard, top-mount and bottom-mount refrigerators typically have wider shelves in each of the fresh food and freezer compartments as compared to the corresponding shelves in a side-by-side refrigerator.

For this reason, it is often difficult, if not impossible, to accommodate rather wide food items, such as trays, cake pans, platters, turkeys and the like, on a given shelf in the fresh food compartment of a side-by-side refrigerator, while the same item(s) could be readily placed on a corresponding shelf in a top-mount or bottom-mount refrigerator. The same is true with respect to the width of different freezer shelves. For example, it is not always possible to store frozen pizza and other large food items widthwise in a side-by-side refrigerator freezer compartment, while such items can be easily arranged widthwise in a freezer compartment of a top-mount or bottom-mount style refrigerator. To compensate for this disadvantage, it is not uncommon for owners of side-by-side refrigerators to purchase a second refrigerator for additional food storage space.

Alternatively, a side-by-side refrigerator can be constructed wherein each of the fresh food and freezer compartments has varying widths as demonstrated in U.S. Pat. No. 6,019,447. With this advantageous construction, a consumer can place more items in an advantageously positioned, larger width section of a selected compartment of the refrigerator, while other items can be placed on shelves located in a narrower width section. In order to seal each of the varying width compartments, the refrigerator illustrated in the '447 patent includes fresh food and freezer compartment doors having varying widths. That is, each of the fresh food and freezer compartment doors includes an inner lateral portion defined by offset vertical sections interconnected by a lateral section.

Based on the weight of a side-by-side refrigerator door itself and the number of food items which can be stored on inner storage shelves or bins of the door, it is known to structurally reinforce a refrigerator door in order to control bowing of the door. Unless adequately supported, refrigerator doors may be limited in the amount or weight of items that can be stored in bins or shelves on the door. Too much weight could cause the seal about the door to unseat, allowing cool air to escape from the refrigerator. A particular problem exists with the type of refrigerators discussed above that have offset sections. That is, the laterally offset sections define a zone of interruption that significantly reduces the strength of the overall door. This zone of interruption can experience a significant amount of thermal bow which can cause a breach of a door seal at this zone. In fact, a change in door gap between a top of the mullion and the zone of interruption can reach 0.25 inches (approximately 0.6 cm). Certainly, not compensating for this type of bowing can lead to significant efficiency losses.

Based on the above, there exists a need in the art to establish a consistent and energy efficient door seal arrangement in connection with a side-by-side refrigerator. In particular, there exists a need in the art for a mullion assembly that provides for proper sealing between a door of an offset side-by-side refrigerator and a mullion assembly of the refrigerator.

SUMMARY OF THE INVENTION

The present invention is directed to employing a bowed mullion arrangement in a side-by-side refrigerator and, most preferably, a side-by-side refrigerator having varying width fresh food and freezer compartments. The refrigerator includes a cabinet shell and liners positioned within the cabinet shell which define laterally spaced, fresh food and freezer compartments separated by a fore-to-aft extending divider wall, with a mullion provided at the front of the divider wall. The mullion is bowed outward from the cabinet so as to define a convex outer surface against which the fresh food and freezer compartment doors seal. With this arrangement, proper sealing is established which compensates for thermal and other bowing associated with the doors.

In the most preferred form of the invention, the divider wall includes first and second interconnected upright portions which are laterally offset to form fresh food and freezer compartments having varying lateral dimensions. Correspondingly, the varying width refrigerator is provided with fresh food and freezer doors, each including an outer lateral portion pivotally mounted to the cabinet shell about a substantially vertical axis and an inner lateral portion defined by laterally offset sections. In this manner, the fresh food and freezer doors have vertically offset, varying width portions adapted to extend across and seal the fresh food and freezer compartments respectively. In this case, the bowed mullion has a longitudinal curvature designed to compensate for a longitudinal bend in the fresh food and freezer doors caused by thermal bowing. Curving the mullion assembly to match the shape of the curved doors provides for a uniform seal to be maintained between the mullion assembly and the fresh food and freezer doors when the doors are in their closed position.

Additional objects, features and advantages of the present invention will become more readily apparent from the following detailed description of a preferred embodiment when taken in conjunction with the drawings wherein like reference numerals refer to corresponding parts in the several views.

DETAILED DESCRIPTION OF THE PREFERRED EMBODIMENT

Figure 1:
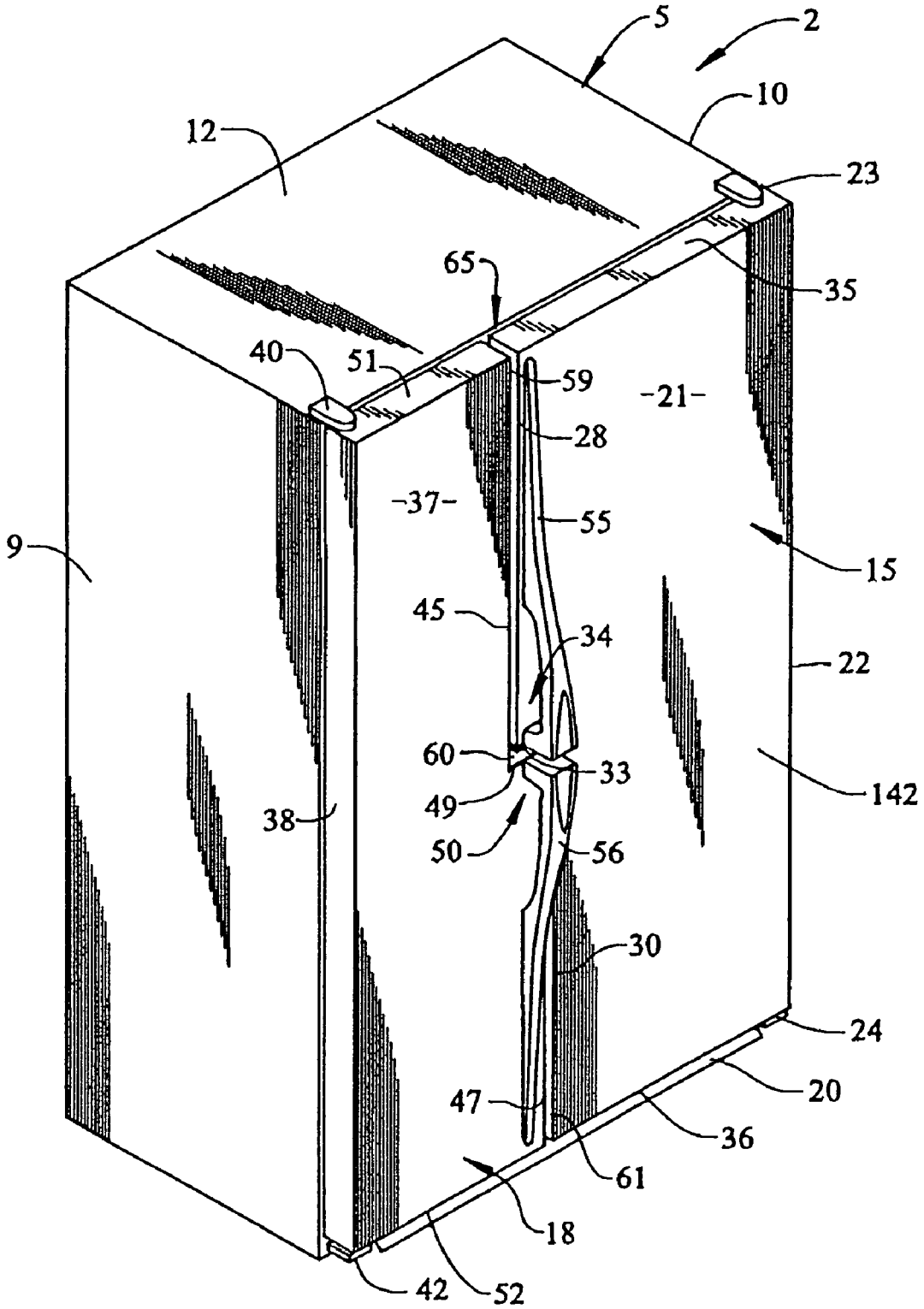
FIG. 1 is an upper left perspective view of a side-by-side refrigerator having varying width doors and a bowed mullion assembly formed in accordance with a preferred embodiment of the invention.

With initial reference to FIG. 1, a refrigerator cabinet constructed in accordance with the present invention is generally indicated at 2. In general, refrigerator cabinet 2 includes a cabinet shell 5 formed from side panels 9 and 10 which are interconnected by a top panel 12. Preferably, cabinet shell 5 is formed from bending a single piece of sheet metal in a manner known in the art. As illustrated, refrigerator cabinet 2 constitutes a side-by-side refrigerator having a fresh food compartment door 15 which is arranged laterally juxtaposed a freezer door 18. Extending laterally across cabinet shell 5, below fresh food and freezer doors 15 and 18, is a kick plate 20.

As shown, fresh food door 15 includes a front face portion 21 and an outer vertical edge portion 22. Fresh food door 15 is pivotally attached to cabinet shell 5 through an upper hinge 23 and a lower hinge 24. As further shown in FIG. 1, fresh food door 15 includes an upper inner edge portion 28, a lower inner edge portion 30 and a lateral edge portion 33 interconnecting the upper and lower inner edge portions 28 and 30. Therefore, upper and lower edge portions 28 and 30 are laterally spaced and extend in vertically offset planes or axes so as to form a laterally offset portion 34 of fresh food door 15. In addition, fresh food door 15 includes upper and lower edge portions 35 and 36 that connect vertical edge portion 22 with upper and lower inner edge portions 28 and 30 respectively.

In a generally similar manner, freezer door 18 includes a front face portion 37 and an outer edge portion 38 which is pivoted at an upper hinge 40 and a lower hinge 42 for movement relative to cabinet shell 5. In addition, freezer door 18 includes an upper inner edge portion 45, a lower inner edge portion 47 and a lateral edge portion 49. At this point, it should be understood that, while lateral edge portions 33 and 49 are shown to extend generally horizontally, these lateral portions could be curvilinear, diagonal or the like without departing from the invention. In any event, upper inner edge portion 45, lower inner edge portion 47 and lateral edge portion 49 form an associated laterally offset portion 50 for freezer door 18. In a manner similar to that described with respect to fresh food door 15, freezer door 18 includes upper and lower edge portions 51 and 52 that interconnect outer edge portion 38 with upper and lower inner edge portions 45 and 47 respectively. Also shown in FIG. 1, fresh food door 15 is provided with a handle 55. Likewise freezer door 18 is provided with a corresponding handle 56.

With this construction, as opposed to a conventional side-by-side refrigerator wherein inner edge portions of fresh food and freezer doors would be spaced by a vertical, single axis gap, fresh food and freezer doors 15 and 18 are spaced in a central zone of refrigerator cabinet 2 by a gap that includes a first vertical component 59 between upper inner edge portions 28 and 45, a lateral component 60 between lateral edge portions 33 and 49, and a second vertical component 61 between lower inner edge portions 30 and 47. Therefore, fresh food door 15 is wider in an upper region thereof than in a lower portion. Correspondingly, freezer door 18 is wider in a lower portion than in an upper portion. As will become more fully evident below, fresh food and freezer doors 15 and 18 conceal corresponding fresh food and freezer compartments of refrigerator cabinet 2 which also have varying width upper and lower sections. In general, refrigerator cabinet 2 with this offset design is disclosed in co-assigned U.S. Pat. No. 6,019,447 which is incorporated herein by reference. Instead, the present invention is particularly directed to the structure of a bowed refrigerator mullion assembly 65 used in connection with properly sealing fresh food and freezer doors 15 and 18 as will be detailed fully below.

Figure 2:
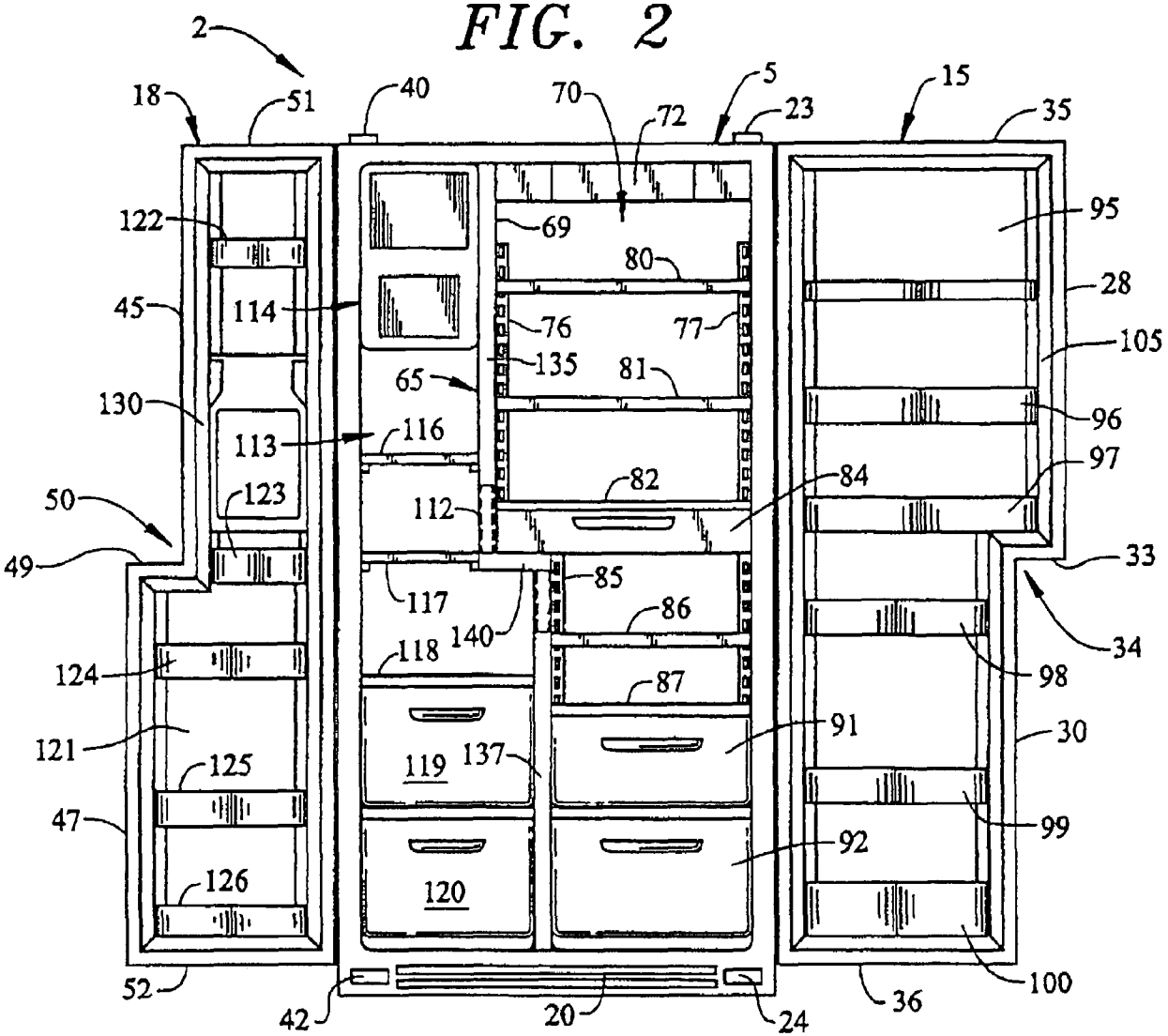
FIG. 2 is a front plan view of the side-by-side refrigerator of FIG. 1, with fresh food and freezer doors thereof shown open and the bowed mullion assembly being exposed.

As best shown in FIG. 2 and provided for the sake of completeness, refrigerator cabinet 2 has mounted therein a liner 69 which defines a fresh food compartment 70. In the embodiment shown, a temperature control unit 72 is shown mounted at an upper portion of fresh food compartment 70 for controlling a temperature in fresh food compartment 70. In addition, laterally spaced vertical rails 76 and 77 are secured to rear wall portions of liner 69 in order to support vertically adjustable shelves 80-82. Shelf 82 is also shown to support a drawer 84. As shown in this figure, rail 77 extends below drawer 84 and is used in combination with a laterally offset intermediate rail 85 to support additional shelves 86 and 87. Finally, refrigerator cabinet 2 includes slidable storage bins 91 and 92 arranged at a lower portion of fresh food compartment 70.

Except for varying in width from typical side-by-side fresh food compartment shelves, drawers and bins, the construction and mounting of shelves 80-82, 86 and 87, drawer 84 and bins 88 and 89 correspond to more commonly known arrangements in the art. Fresh food door 15 is provided with a liner 95 and can also be provided with various food item storage units, such as shelves 96-99, a bin 100 and the like. Again, these storage units are known in the art and it is to be understood that they merely depict exemplary storage arrangements provided for the sake of completion. In addition, it should be realized that fresh food door 15 includes a door seal or gasket 105, with door seal 105 extending about liner 95, generally spaced from, yet tracking, a perimeter defined by outer vertical edge 22, upper inner edge portion 28, lower inner edge portion 30, lateral edge portion 33, upper edge portion 35 and lower edge portion 36.

In a similar manner, a freezer liner 112 is mounted within cabinet shell 5 that defines a freezer compartment 113. In the embodiment shown, freezer compartment 113 has mounted therein an ice maker unit generally indicated at 114, various vertically spaced shelves 116-118 and lower most slidable bins 119 and 120. The inside of freezer door 18 includes a liner 121 and various shelves 122-126. Again, all of these food item supporting units are known in the art and have simply been sized to correspond to the various storage areas shown. In a manner similar to fresh food door 15, the inside of freezer door 18 is provided with a door seal or gasket 130, with door seal 130 extending about liner 121, generally spaced from, yet tracking, a perimeter defined by outer vertical edge 38, upper inner edge portion 45, lower inner edge portion 47, lateral edge portion 49, upper edge portion 51 and lower edge portion 52.

It should be realized that fresh food and freezer compartments 70 and 113 have varying width sections corresponding to that of fresh food and freezer doors 15 and 18. Accordingly, mullion assembly 65 has a different configuration than that found in more conventional side-by-side refrigerators. More specifically, mullion assembly 65 includes an upper portion 135 and a lower portion 137 which are interconnected by a laterally extending portion 140. Mullion assembly 65 can actually be interconnected to cabinet shell 5 in various ways known in the art. Preferably, mullion assembly 65 is interconnected to the top and bottom flanges 145 and 146 of cabinet shell 5 through the use of mullion bar retainers 149 and 150 (see FIG. 4 and further discussion below) such as in a manner corresponding to that set forth in co-assigned U.S. Pat. No. 5,992,960 which is incorporated herein by reference.

Figure 4:
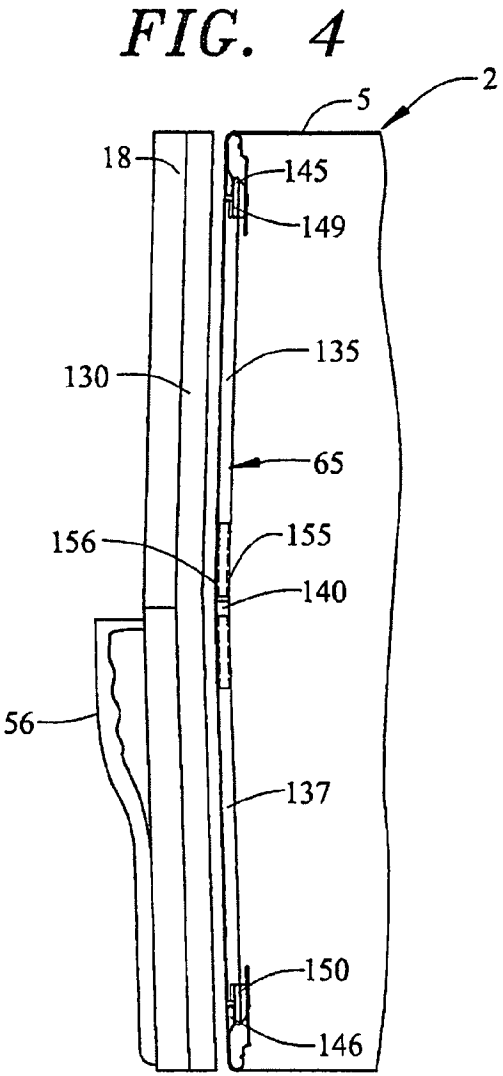
FIG. 4 is a partial cross-sectional side view generally taken along line 4-4 of the side-by-side refrigerator of FIG. 3, but with the freezer door partially open to illustrate the bowed mullion according to a preferred embodiment of the present invention.
Figure 3:
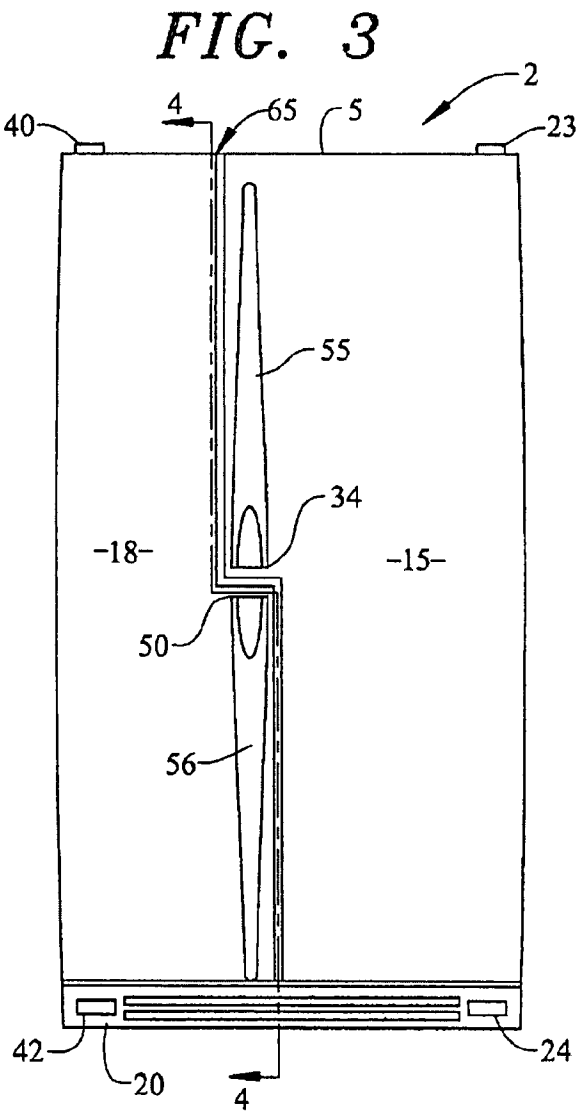
FIG. 3 is a front plan view of the side-by-side refrigerator of FIG. 2 with the doors closed.

FIGS. 3 and 4 will now be referenced in describing the construction of mullion assembly 65 according to a preferred embodiment of the present invention. As indicated above, the inclusion of laterally offset portions 34 and 50 in fresh food and freezer compartment doors 15 and 18 can significantly increase thermal bowing which, in turn, can adversely affect proper door sealing. Mullion assembly 65 is specifically constructed to account for this door bowing, preferably avoiding the need for additional, extremely costly door reinforcement structure. With this in mind, FIG. 4 shows a partial cross-sectional side view of refrigerator cabinet 2 taken along line 4-4 of FIG. 3. As previously discussed, mullion assembly 65 comprises an upper portion 135 and a lower portion 137 which are interconnected by laterally extending portion 140. Upper portion 135 is shown interconnected to refrigerator shell 5 by retainer 149. More specifically, retainer 149 engages upper portion 135 and top flange 145, while retainer 150 engages lower portion 137 and bottom flange 146, thereby fixedly retaining mullion assembly 65 within refrigerator 2. Without substantial reinforcement, the existence of offset portions 34 and 50 approximately halfway down each of doors 15 and 18 will cause thermal bowing of doors 15 and 18. If this thermal bowing is not counteracted, the contact between cabinet shell 5 and each of door seals 105 and 130 will be incomplete, thereby allowing cold air to undesirably escape from refrigerator cabinet 2. However, in accordance with the present invention, the amount of thermal bowing of fresh food and freezer doors 15 and 18 is predetermined and the mullion assembly 65 is formed with a complementary bowed surface. By matching the overall longitudinal bowing of the mullion assembly 65 to the longitudinal curvature of fresh food and freezer doors 15 and 18, any gap between door seals 105 and 130 and mullion assembly 65 is eliminated.

In the most preferred form of the invention, mullion assembly 65 includes a concave inner portion 155 and a convex outer portion 156, with the convex portion 156 having a curvature which conforms to an inner concave curvature associated with each of offset fresh food and freezer doors 15 and 18 at seals 105 and 130 respectively. By specifically forming mullion assembly 65 in this bowed fashion, uniform sealing with mullion assembly 65, without the need for additional structural supports in fresh food and freezer doors 15 and 18, can be maintained. Although mullion assembly 65 is depicted in FIG. 4 as having a continuous longitudinal curve with a single convex outer surface 155 and one concave inner surface 156, it should be understood that mullion assembly 65 could have various, differently curved portions depending on the configuration and designed weighting of fresh food and freezer doors 15 and 18 to maintain the desired uniform sealing between fresh food and freezer doors 15 and 18 and mullion assembly 65.

Although described with reference to a preferred embodiment of the present invention, it should be readily apparent to one of ordinary skill in the art that various changes and/or modifications can be made to the invention without departing from the spirit thereof. For example, the mullion assembly need not be a one piece mullion, but can comprise various pieces, so long as the overall mullion assembly is bowed to account for the bowing associated with the refrigerator doors. In addition, although the present invention has particular application in side-by-side refrigerators having varying width fresh food and freezer compartments, a corresponding arrangement could be employed with a more conventional side-by-side refrigerator configuration. Furthermore, although not specifically addressed above, it should be recognized that each of the fresh food and freezer liners are preferably thermoformed with flange configurations which have mating shapes to match the mullion. In general, the invention is only intended to be limited to the following claims.

We claim:

1. A refrigerator comprising:

a cabinet shell including a pair of laterally spaced side panels, a top panel interconnecting upper end portions of the laterally spaced side panels and an open frontal zone permitting access to within the cabinet shell and including top and bottom flanges;

at least one liner positioned within the cabinet shell, said at least one liner defining laterally spaced, fresh food and freezer compartments separated by a fore-to-aft extending divider wall;

fresh food and freezer doors pivotally mounted to the cabinet shell about substantially vertical axes for rotation between open and closed positions, each of the fresh food and freezer doors including a front face portion, an inner portion and a door seal extending about the inner portion; and a longitudinally extending generally vertical mullion connected to the top and bottom flanges and located laterally between the fresh food and freezer compartments and against which the door seals abut when the fresh food and freezer doors assume their closed positions, said mullion being bowed in vertical cross-section substantially from the top flange to the bottom flange to have an outer convex surface having a vertical longitudinal curvature which is engaged by the door seals when the fresh food and freezer doors are in their closed positions, wherein the fresh food and freezer doors maintain a substantially uniform seal against the mullion assembly when the doors are in their closed positions.

2. The refrigerator according to claim 1, wherein each of the fresh food and freezer compartments has varying lateral dimensions.

3. The refrigerator according to claim 2, wherein the fresh food and freezer doors have vertically offset, varying width portions adapted to extend across and seal the fresh food and freezer compartments respectively.

* * * * *